US006428675B1

(12) United States Patent
Tomaswick

(10) Patent No.: US 6,428,675 B1
(45) Date of Patent: Aug. 6, 2002

(54) LOW TEMPERATURE ALUMINUM PRODUCTION

(75) Inventor: Kathleen M. Tomaswick, Natrona Heights, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/615,432

(22) Filed: Jul. 13, 2000

(51) Int. Cl.[7] ..... C25C 3/08; C25C 3/06
(52) U.S. Cl. ..... 205/372; 205/392
(58) Field of Search ..... 205/389, 392, 205/394, 372

(56) References Cited

U.S. PATENT DOCUMENTS

| | | | | |
|---|---|---|---|---|
| 503,929 A | | 8/1893 | Hall | |
| 1,206,874 A | | 12/1916 | McAfee | |
| 1,297,946 A | * | 3/1919 | Weaver | 205/392 |
| 1,566,694 A | | 12/1925 | Railsback | |
| 3,257,296 A | | 6/1966 | Berghaus et al. | 204/64 |
| 3,725,222 A | | 4/1973 | Russell et al. | 204/67 |
| 4,115,215 A | | 9/1978 | Das et al. | 204/67 |
| 4,214,955 A | | 7/1980 | Bowman | 204/67 |
| 4,214,956 A | | 7/1980 | Bowman | 204/67 |
| 4,595,466 A | | 6/1986 | Josefowicz | 204/67 |
| 5,015,343 A | | 5/1991 | LaCamera et al. | 204/67 |
| 5,378,325 A | | 1/1995 | Dastolfo, Jr. et al. | 204/66 |
| 5,725,744 A | | 3/1998 | deNora et al. | 204/244 |

OTHER PUBLICATIONS

Haupin, W.E., "Oxide Solubility in Lithium Chloride–Aluminum Chloride Melts", *Light Metals*, vol. 1, 1979, pp. 353–361. (No Month).

* cited by examiner

*Primary Examiner*—Donald R. Valentine
(74) *Attorney, Agent, or Firm*—Julie W. Meder; Glenn E. Klepac

(57) ABSTRACT

A process for electrolyzing $Al_2O_3$ to produce aluminum in a low temperature bath containing $AlCl_3$ and an alkali metal chloride. The bath is maintained at a temperature of less than about 300 ° C. Solid aluminum is produced at the cathode in a frozen layer of the alkali metal chloride.

12 Claims, 4 Drawing Sheets

LOW TEMPERATURE ALUMINUM PRODUCTION

Background of the Invention

1. Field of the Invention

The present invention relates to low temperature production of aluminum in an electrolytic cell, in particular, production of aluminum at 200° C. or less.

2. Prior Art

A conventional method for producing aluminum which has been employed for decades is the Hall-Heroult process. In a Hall-Heroult process, alumina is electrolytically reduced to aluminum. A molten electrolytic bath typically including sodium cryolite ($Na_3AlF_6$) and other additives is contained in a carbon lined cell. Anodes positioned in an upper portion of the cell extend downwardly through the top of the bath. Electric current is supplied to the anodes to provide a source of electrons for reducing the alumina to aluminum which accumulates as a molten aluminum pad. The molten aluminum pad forms a liquid metal cathode. A cathode assembly positioned in a bottom of the cell supports the molten aluminum pad and completes the cathodic portion of the cell. Upon introduction of alumina into the molten electrolyte bath, the alumina dissolves and reacts to form molten aluminum and carbon dioxide according to the following reaction:

$$Al_2O_3+3/2C \rightarrow 2Al+3/2CO_2$$

Cryolite melts at about 910° C., hence this process is performed at about 950° C. or higher. At this high temperature, the electrolyte and molten aluminum aggressively react with the materials forming the cathode assemblies and the cell itself with concomitant difficulties in containing the reactants. One solution to this problem has been to operate aluminum production cells with relatively high heat losses so that a frozen layer of the bath forms on the inner walls of the cell. However, this solution also has drawbacks in the energy losses associated therewith, the costs for disposal of spent cells and difficulties encountered in maintaining the thickness of the frozen bath layer when regulating the bath temperature. Smelting processes using non-consumable (inert) anodes which produce oxygen are likewise subject to these heat balance problems.

Attempts have been made at lowering the temperature of the Hall-Heroult process. One route to this goal is to use a solvent having a lower melting point than cryolite. U.S. Pat. No. 3,725,222 describes a method of producing aluminum from $AlCl_3$ with an electrolyte bath of alkali metal chloride or alkaline earth metal chlorides at a temperature below 730° C. but above the melting point for aluminum (660° C.). Although this process operates at a lower temperature than Hall-Heroult electrolytic decomposition of alumina, bath temperatures over 660° C. are still problematic. In addition, $AlCl_3$ electrolysis requires relatively pure $AlCl_3$ as a feed material which is costly and renders commercial use of this process prohibitively expensive. Another similar proposal described in "Light Metals", Vol. 1, 1979, pp. 353-361 suggests production of aluminum from alumina in a LiCl/$AlCl_3$ bath to form a species of AlOCl which is then electrolyzed at 700° C.

Low temperature salt bath processes also exhibit low alumina solubility and low alumina solution rates. This can be overcome by using specialized grades of alumina to control the water content therein such as disclosed in U.S. Pat. Nos. 3,852,173 and 3,951,763. Unfortunately, these approaches leave the anodes subject to degradation and are also commercially unacceptable due to the cost of the specialized grades of alumina.

Other attempts to improve the Hall-Heroult process have focused on the use of non-consumable (inert) anodes in metal chloride baths. See U.S. Pat. No. 4,681,671. More recently, U.S. Pat. No. 5,013,343 discloses electrolysis of alumina with inert anodes in very low solubility conditions (less than 1 weight percent alumina) allowing for lower bath temperatures. However, this system is only feasible when the surface area of the anode is greatly increased such as by drilling numerous holes deep into the anode. U.S. Pat. No. 5,725,744 describes a similar system in which the physical characteristics of the anodes are altered to improve efficiency.

Another drawback to conventional Hall-Heroult processes resides in the use of cryolite. When a Hall-Heroult cell experiences a condition know as anode effect, fluoride in the cryolite is released, usually in the form of HF or $CF_4$. Emissions of HF, $CF_4$ and other fluoride compounds are environmentally hazardous. Hence, an electrolyte bath without fluoride compounds is desirable.

Accordingly, a need remains for a non-fluoride based electrolyte system which is operable at temperatures well below those employed in conventional Hall-Heroult processes, avoids the need for specialized alumina and may be operated with conventional styled anodes.

SUMMARY OF THE INVENTION

This need is met by the process of the present invention which includes a method of producing aluminum in an electrolytic cell having the steps of (a) providing an anode and a cathode in a molten bath containing $AlCl_3$ and an alkali metal chloride, the bath having a temperature of less than about 300° C. and;(b) passing a current between the anode and the cathode; and (c) adding $Al_2O_3$ to the bath such that solid aluminum is produced at the cathode. The alkali metal chloride is selected from the group consisting of NaCl, LiCl, KCl, $MgCl_2$, $CaCl_2$, $BeCl_2$, $BaCl_2$, and combinations thereof, and preferably is NaCl. The concentration of alkali metal chloride in the bath is about 10 to 50 mole percent The molten bath is maintained at a temperature of no more than about 200° C., preferably at about 150 to 200° C.

Prior to step (b), the cell is pre-electrolyzed by setting a voltage between the anode and the cathode at a level which causes the current to drop to zero to eliminate oxides in the bath. Preferably, the pre-electrolysis voltage level is less than about 2.0 volts, more preferably about 1.5 to 1.7 volts.

Upon addition of alumina to the cell, aluminum is produced at the cathode. When the cell is operated at sufficiently high cathode current densities, the electrolytic reaction is driven so that the concentration at the cathode of the aluminum species undergoing electrolysis is very low or zero causing the alkali metal chloride to solidify at the cathode. In this manner, solid aluminum is trapped in the frozen alkali metal chloride.

A complete understanding of the invention will be obtained from the following description when taken in connection with the accompanying drawing figures.

DETAILED DESCRIPTION OF THE PREFERRED EMBODIMENTS

Figure 1A:
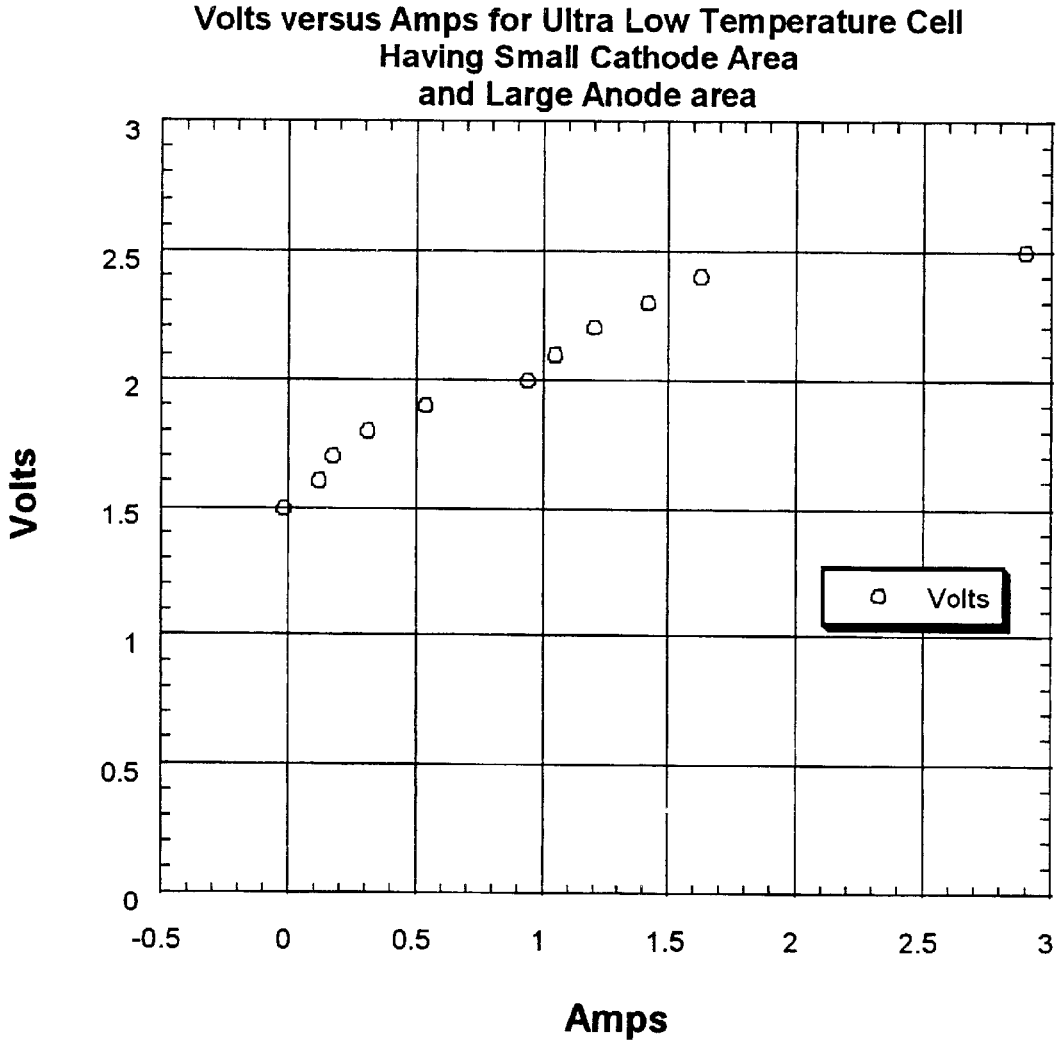
FIG. 1*a* is a graph of the applied voltage versus measured current for the cell used in Example 1.

The present invention includes a method of producing aluminum from alumina at temperatures well below the process temperatures for conventional Hall-Heroult electrolysis techniques.

The present invention takes advantage of the various energies of disassociation for certain compounds. In particular, a cell voltage of 1.2 V is needed to disassociate $Al_2O_3$, whereas $AlCl_3$ disassociates at 1.8 V and NaCl disassociates at 2.2 V. Hence, by controlling the energy delivered to the cell, the disassociation of the feed material and electrolytes in the bath can likewise be selectively controlled.

The electrolyte bath of the present invention includes $AlCl_3$ with additives including one or more alkali metal chlorides. Preferred alkali metal chlorides include NaCl, LiCl and KCl, with NaCl being most preferred. The concentration of the alkali metal chloride in the $AlCl_3$ bath is preferably about 10 to 50 mole percent alkali metal chloride with balance being $AlCl_3$. The melting point of an $AlCl_3$—NaCl bath is about 150° C. Accordingly, an electrolytic cell containing this $AlCl_3$—NaCl bath is operable at relatively low temperatures above 150° C. A preferred bath temperature range is about 170–180° C.

In a preferred process of the present invention, an electrolytic cell containing a molten bath of $AlCl_3$ and one or more alkali metal chlorides is maintained above the melting point of the $AlCl_3$-alkali metal chloride solution. Current is applied to the cell at a voltage of about 1.8 V to eliminate any excess oxides present in the bath. Deoxidization is complete when the current falls to zero. The cell is then ready for introduction of alumina. Alumina is added to the cell in a conventional manner and the current accordingly rises to operational levels for disassociation of alumina. Solid aluminum forms at the cathode assembly, and a gas is liberated. It is believed that an aluminum-oxygen-chlorine species (AlOCl) is formed which subsequently ionizes to form solid Al at the cathode surface and $O_2$ at the anode.

Distinct advantages of the present invention over prior techniques for electrolyzing include the use of lower operating temperatures and the production of solid aluminum. When operating at temperatures no greater than about 200° C., heat losses in the cell are greatly reduced. Typically, one-third of the heat applied to a conventional Hall-Heroult cell is lost when controlling the frozen electrolyte bath layer. These heat losses are substantially avoided when practicing the present invention. Accordingly, the containment apparatus for the smelting process may be formed from a wide variety of less costly insulating materials (e.g. fiberglass). In addition, solid aluminum is more easily handled than the molten aluminum. Handling of molten aluminum formed in a conventional Hall-Heroult cell is problematic because it must be transported at high temperatures (above about 700° C.) with associated containment problems In contrast, solid aluminum can be removed from the cell with minimal specialized handling equipment. In addition, the solid aluminum formed according the method of the present invention often contains residual NaCl. For certain applications, this can be beneficial. Alternatively, the salt may be readily removed, for example, by screening the salt from the aluminum.

Although the invention has been described generally above, particular examples give additional illustration of the product and process steps typical of the present invention.

EXAMPLE 1

A bath consisting of 1300 grams of a mixture of NaCl and anhydrous $AlCl_3$ in a molar ratio of 2:3, respectively, was charged into a quartz crucible. A graphite rod 0.75 inch in diameter was used as the anode and was suspended 3 inches into the bath. A ⅜ inch diameter graphite rod was used as the cathode. The crucible was enclosed and argon was delivered as a cover gas. The crucible was placed in a furnace to heat the bath to 190–200° C. to melt and solubilize the salts. The bath was pre-electrolyzed by driving the current to zero using a voltage of about 1.8–2.0 V. After the pre-electrolysis, 20–40 grams of smelting grade alumina were added to the bath. The cell was operated overnight at a voltage of less than or equal to about 1.7 V and current density of about $0.5A/in^2$. A solid deposit formed on the cathode and was confirmed by x-ray analysis to include aluminum as a major component. Other components in the deposit included $NaAlCl_4$ and $AlCl_3$-6($H_2O$).

EXAMPLE 2

An electrolytic cell was operated as in Example 1 except that the crucible was charged with 645 grams of the salt mixture and a 2 inch by 2 inch vertical graphite plate was used as the cathode. After one week of operation at 1.5–1.7 V, no metal was found at the cathode. The bath was tested for the ability to dissolve aluminum by suspending an aluminum rod into the molten salt. The rod lost about 2–3 grams in weight, yet, still no metal was recovered at the cathode. This indicated that both the produced aluminum and the aluminum from the suspended rod had dissolved into the salt bath. These results demonstrate the opportunity to operate a smelting cell wherein frozen aluminum recovery is achieved at the cathode or wherein the bath is pre-saturated with aluminum to allow for recovery of aluminum at a distance from the cathode.

Figure 1B:
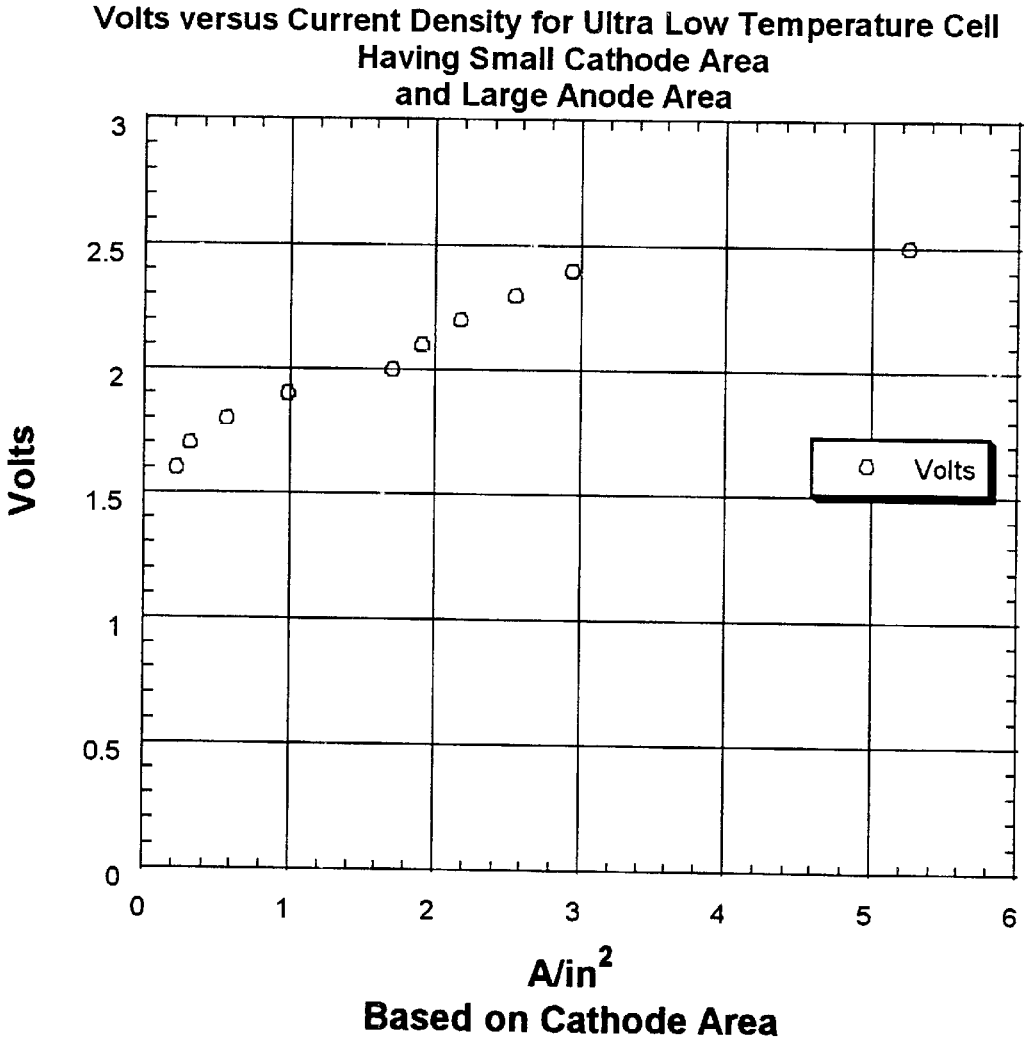
FIG. 1*b* is a graph of the applied voltage versus current density for the cell used in Example 1.
Figure 2A:
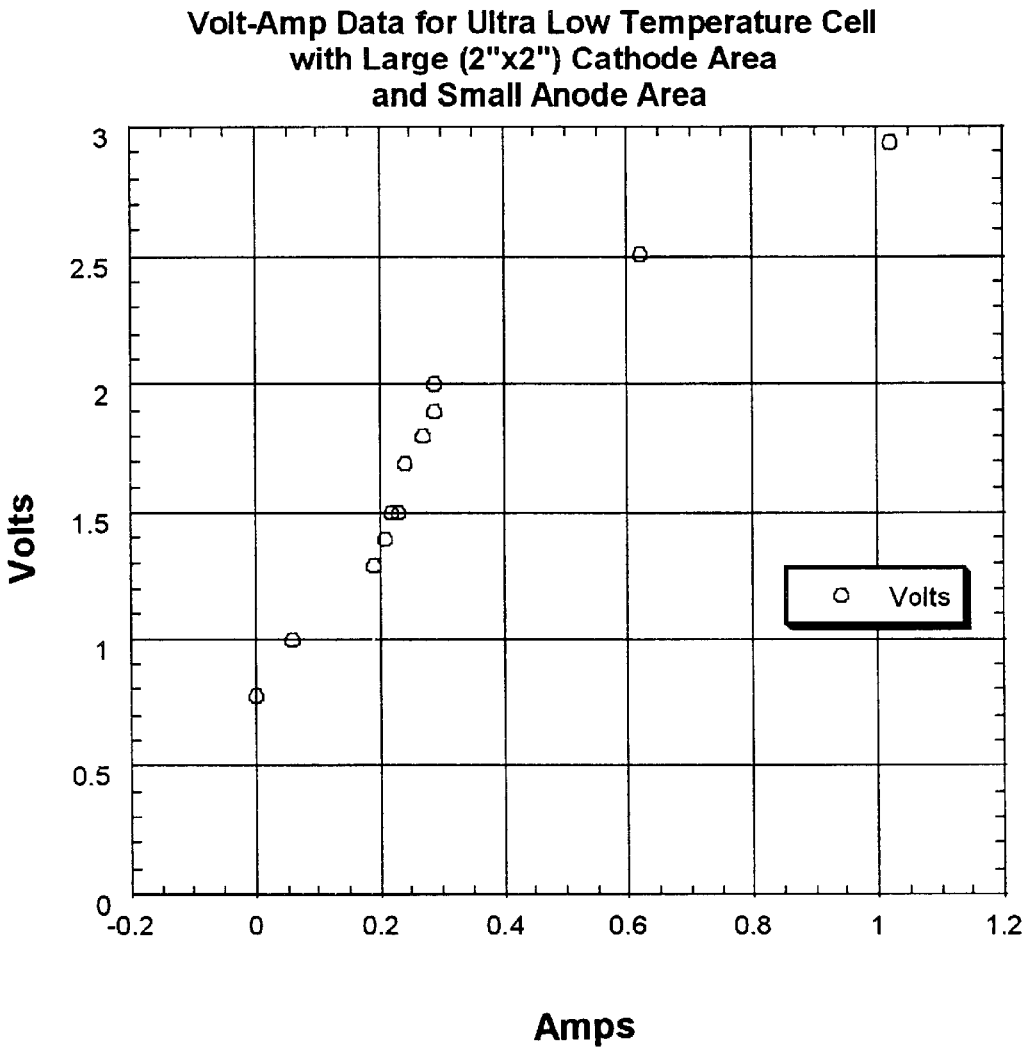
FIG. 2*a* is a graph of the applied voltage versus measured current for the cell used in Example 2.
Figure 2B:
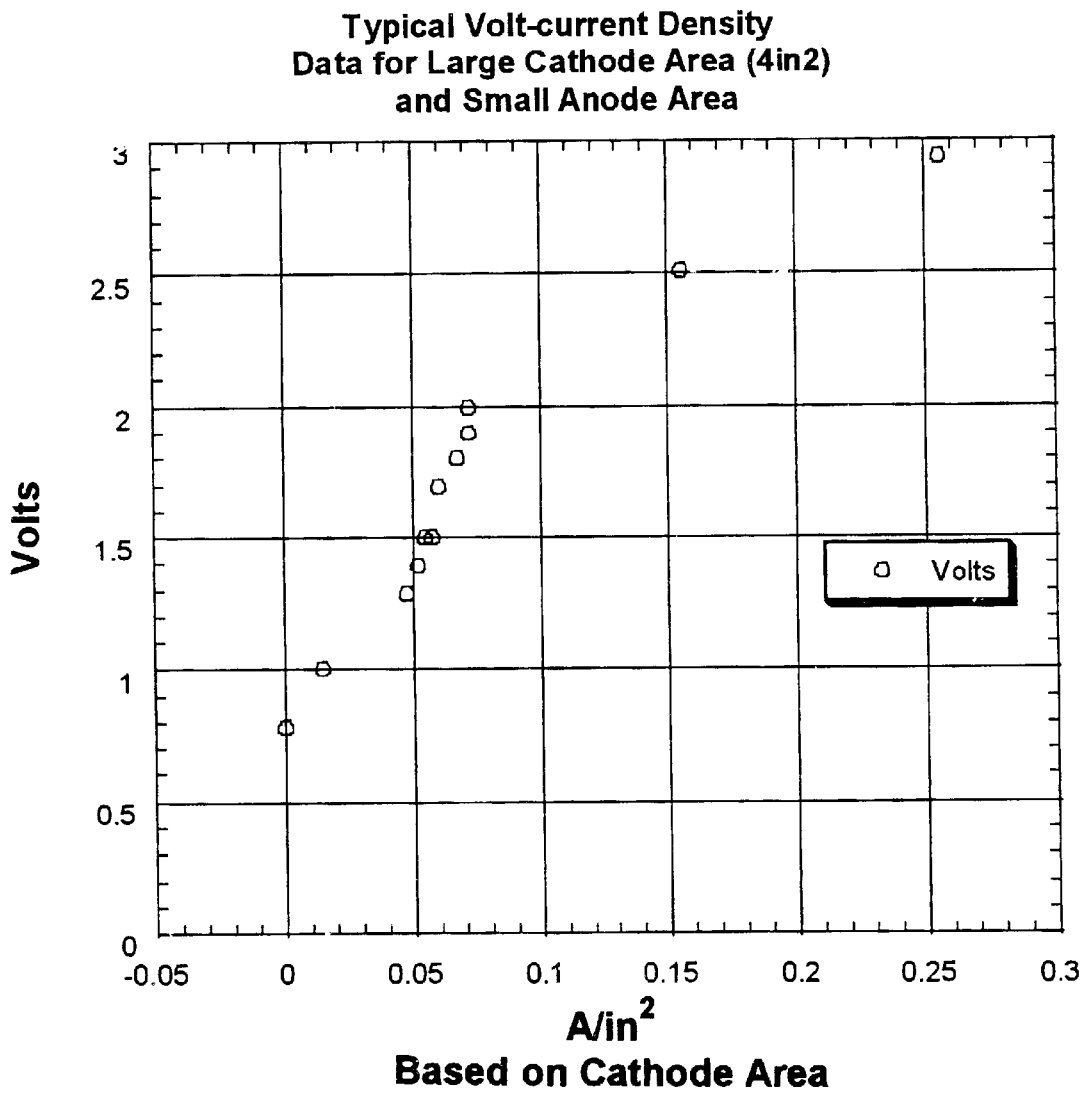
FIG. 2*b* is a graph of the applied voltage versus current density for the cell used in Example 2.

FIGS. 1*a* and 2*a* are graphs of the applied voltage versus measured current for the cells of Examples 1 and 2, respectively. FIGS. 1*b* and 2*b* are graphs of the applied voltage versus measured current for the cells of Examples 1 and 2, respectively. The data points in the graphs for voltages above 2.0 V are believed to represent conditions at which species other than the desired aluminum species disassociated. A comparison of FIGS. 1*b* and 2*b* indicates that high current density is a factor in recovering solid metal at the cathode. It is believed that the Al—O species present adjacent a cathode having a sufficiently high current density is immediately consumed and converted to aluminum. This produces a concentration gradient at the cathode wherein the concentration of NaCl (or other alkali metal chloride) adjacent the cathode is very high and the concentration of Al—O species is zero (immediate consumption) or very low adjacent the cathode. As the distance from the cathode increases, the salt concentration decreases and the Al—O species concentration increases. The melting point of NaCl is significantly higher than the melting point of the electrolytic bath and of aluminum, hence, NaCl freezes at the cathode, trapping solid aluminum in a matrix of solid NaCl.

Accordingly, it is believed that the process of the present invention should be performed such that the reaction forming aluminum creates a concentration gradient of Al/NaCl. This may be accomplishing by selecting an current density for the particular physical parameters of the electrolytic cell. Aluminum was trapped in frozen NaCl in Example 1 when the cathode current density was over $0.2\ A/in^2$. Higher efficiencies can be achieved by applying a voltage level over that necessary to drive the reaction yet not cause the components of the electrolytic bath to disassociate.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

What is claimed is:

1. A method of producing aluminum from alumina in an electrolytic cell comprising:

(a) providing an anode and a cathode in contact with a molten bath containing $AlCl_3$ and an alkali metal chloride, the bath having a temperature of less than about 300° C.;

(b) passing a current between the anode and the cathode; and (c) adding alumina to the bath such that alumina disassociates and solid aluminum is produced at the cathode.

2. The method as claimed in claim 1 wherein the alkali metal chloride is selected from the group consisting of NaCl, LiCl, KCl, $MgCl_2$, $CaCl_2$, $BeCl_2$, and $BaCl_2$.

3. The method as claimed in claim 1 wherein the alkali metal chloride is NaCl.

4. The method as claimed in claim 1 wherein the concentration of the alkali metal chloride in the bath is about 10 to 50 mole percent.

5. The method as claimed in claim 1 wherein the temperature is no more than about 200° C.

6. The method as claimed in claim 5 wherein the temperature is about 150 to 200° C.

7. A method of producing aluminum in an electrolytic cell comprising:

(a) providing an anode and a cathode in contact with a molten bath containing $AlCl_3$ and an alkali metal chloride, the bath having a temperature of less than about 300° C. and setting a voltage between the anode and the cathode at a level which causes the current between the anode and the cathode to drop to zero;

(b) passing a current between the anode and the cathode; and (c) adding alumina to the bath such that solid aluminum is produced at the cathode.

8. The method as claimed in claim 7 wherein the voltage in step (b) is set at less than about 2.0 volts.

9. The method as claimed in claim 8 wherein the voltage is set at about 1.5 to 1.7 volts.

10. A method of producing aluminum in an electrolytic cell comprising:

(a) providing an anode and a cathode in contact with a molten bath containing $AlCl_3$ and an alkali metal chloride, the bath having a temperature of less than about 300° C.;

(b) passing a current between the anode and the cathode;

(c) adding alumina to the bath such that alumina disassociates and solid aluminum is produced at the cathode and;

(d) freezing the alkali metal chloride at the cathode.

11. The method as claimed in claim 10 further comprising trapping the solid aluminum in the frozen alkali metal chloride.

12. The method as claimed in claim 11 wherein the cathode current density is at least about 0.2 $A/in^2$.

* * * * *